US006875135B2

(12) United States Patent
Tracy, Sr.

(10) Patent No.: US 6,875,135 B2
(45) Date of Patent: Apr. 5, 2005

(54) METHOD AND APPARATUS FOR TRAINING ATHLETES

(76) Inventor: Kevin A. Tracy, Sr., 3233 Dimaggio Way, Antioch, CA (US) 94509

( * ) Notice: Subject to any disclaimer, the term of this patent is extended or adjusted under 35 U.S.C. 154(b) by 0 days.

(21) Appl. No.: 10/646,582

(22) Filed: Aug. 22, 2003

(65) Prior Publication Data

US 2005/0043121 A1 Feb. 24, 2005

(51) Int. Cl.[7] ..... A63B 69/00

(52) U.S. Cl. ..... 473/438; 450/458; 450/464; 450/422

(58) Field of Search ..... 473/422, 59, 215–217, 473/450, 458, 464, 615; 482/121, 122, 124, 125; 128/846, 875–877; 280/288.4, 290

(56) References Cited

U.S. PATENT DOCUMENTS 650,656 A * 5/1900 Raabe ..... 482/124
866,495 A * 9/1907 Marks ..... 482/124
1,618,273 A * 2/1927 Davidson ..... 482/124
3,534,957 A * 10/1970 Houston et al. ..... 473/438
4,685,671 A * 8/1987 Hagerman et al. ..... 482/124
4,955,608 A * 9/1990 Dougherty et al. ..... 473/450
5,062,642 A * 11/1991 Berry et al. ..... 473/277
5,203,754 A * 4/1993 Maclean ..... 482/124
5,207,627 A * 5/1993 Doran ..... 482/124
5,303,927 A * 4/1994 Perry et al. ..... 473/215
5,460,385 A * 10/1995 Lazzeroni ..... 473/464
5,643,159 A * 7/1997 Iavarone ..... 482/125
5,647,827 A * 7/1997 Gutkowski et al. ..... 482/124
5,695,437 A * 12/1997 Olschansky et al. ..... 482/122
5,993,362 A * 11/1999 Ghobadi ..... 482/124
6,179,760 B1 * 1/2001 Rumbaugh ..... 482/121
6,551,221 B1 * 4/2003 Marco ..... 482/74

* cited by examiner

*Primary Examiner*—Mitra Aryanpour
(74) *Attorney, Agent, or Firm*—Charles L. Thoeming

(57) ABSTRACT

An apparatus for training athletes to maintain proper posture and lower body position by keeping the hips low, knees bent, and feet under the hips shoulders using at least two side straps each connected at one end to the athlete's waist and connected at the other end to the athlete's heel. A method for training athletes to improve their ability to maintain proper posture and balance in a range of sporting activities is also disclosed.

19 Claims, 4 Drawing Sheets

METHOD AND APPARATUS FOR TRAINING ATHLETES

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

This invention relates generally to an apparatus and method of using the same for training athletes to maintain an advantageous stance or position, and more particularly to an apparatus and method for training athletes to keep a low body position and center of gravity by use of the legs and hips.

2. Description of the Related Art

A search of the prior art located did not provide any United States patents which are remotely similar to the present invention.

In some sporting activities, such as football, metal chutes are used to force the down linemen to remain in proper low center of gravity postures prior to the snap and engaging the rush of the defensive linemen. Other practice aids have been patented for football; however, none teach the specific training posture of the present invention. U.S. Pat. No. 4,211,017, issued Jul. 8, 1980, for example, provides a VELCRO® lined elongated strip which positions players in a variety line-of-scrimmage scenarios. U.S. Pat. No. 3,804,409, issued Apr. 16, 1974, discloses an apparatus for kicking a football tethered to a stake by an elastic cord so that the football returns to the kicker. U.S. Pat. No. 5,252,076, issued Oct. 12, 1993, discloses an apparatus for training athletes to track a football in motion and to react quickly to unexpected deflections of the path of the football, preferably with their hands.

In other sporting pursuits, efforts have been made to teach techniques and body position. U.S. Pat. No. 4,424,040, issued Jan. 3, 1984, provides a halter apparatus to be positioned below a beginner skier's waist and tethered to an experienced skier following behind. U.S. Pat. No. 5,378,156 provides a teaching aid wherein a pupil is supported by a cradle at the pupil's mid-section and whereby an instructor controls the pupil's weight distribution and orientation to the ski surface by moving the cradle and by eye contact and verbal communication with the pupil.

BRIEF SUMMARY OF THE INVENTION

The present invention provides an easy to use, lightweight, and inexpensive apparatus to use for training athletes to keep a low center of gravity during certain phases of athletic performances or competition, and the method of using the same.

Many athletic performances, or portions thereof, require the athlete to maintain a low center of gravity for maximum performance results. These athletic activities include, but in no way are limited to, wrestling, football, tennis, skiing, baseball, basketball, and the like. Maintaining a low center of gravity at various times in these sporting pursuits allows the athlete to maximize uplift or stability power from leg strength while keeping the center of gravity close to the ground. An ongoing problem with new participants in these and other sports is training the proper posture and balance to maintain this low center of gravity and teaching the athlete to achieve this posture, principally using the legs and hips.

It is an objective of the present invention to provide an apparatus which easily teaches an athlete to maintain the proper posture and balance for maximizing leg strength and power while keeping the athlete's center of gravity low.

It is a further objective of the present invention to provide an apparatus which is light and inexpensive to assist in teaching the proper posture techniques in various phases of competition or a sport.

It is yet another objective of the present invention to provide a training apparatus which gives the athlete immediate feedback when the athlete deviates from the optimum and desired posture.

It is still another objective of the present invention to provide a training apparatus which allows a coach or instructor to immediately spot an athlete who deviates from the optimum and desired posture.

It is a further objective of the present invention to provide an apparatus which is easily adjustable to fit a range of athletes of varying heights to achieve proper posture techniques in various phases of competition or a sport.

Other features, advantages, and objects of the present invention will become apparent with reference to the following description and accompanying drawings.

BRIEF DESCRIPTION OF DRAWINGS

The present invention will become more fully understood from the detailed description provided herein below and the accompanying drawings which are given by way of illustration only, and thus do not limit the present invention, and wherein.

DETAILED DESCRIPTION OF THE INVENTION

The present invention provides a novel apparatus useful in teaching athletes the proper posture and position for various sports and phases of athletic competition within each sport.

Figure 1:
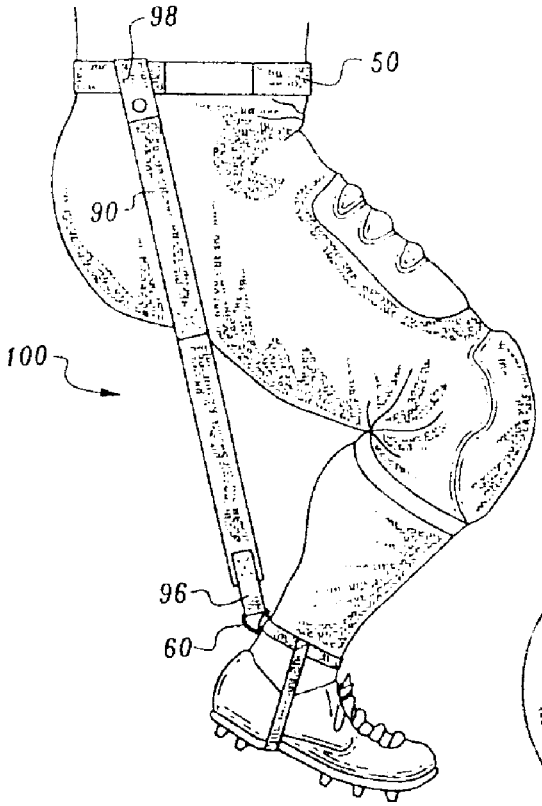
FIG. 1 shows the waist strap, attached side strap, and foot strap elements of an embodiment of the present invention on an athlete.
Figure 2:
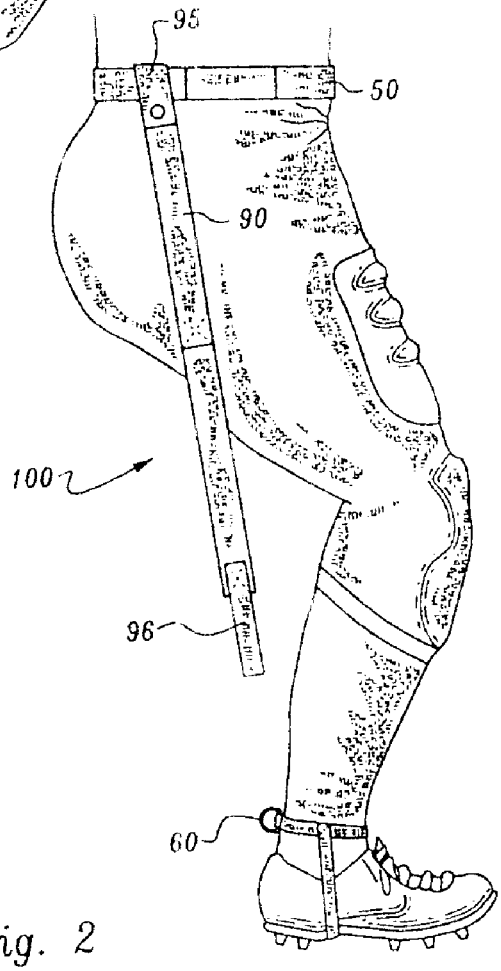
FIG. 2 shows the apparatus of an embodiment of the present invention with an athlete who has exceeded the predetermined angle for a football offensive lineman thus releasing the side straps from the toot straps.
Figure 3:
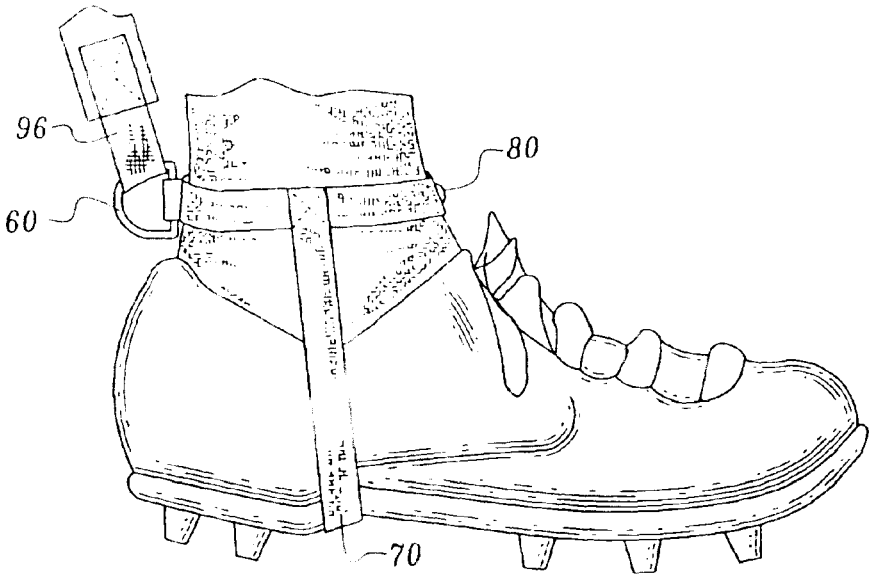
FIG. 3 shows the foot strap elements of an embodiment of the present invention in position around the footwear of an athlete.
Figure 4:
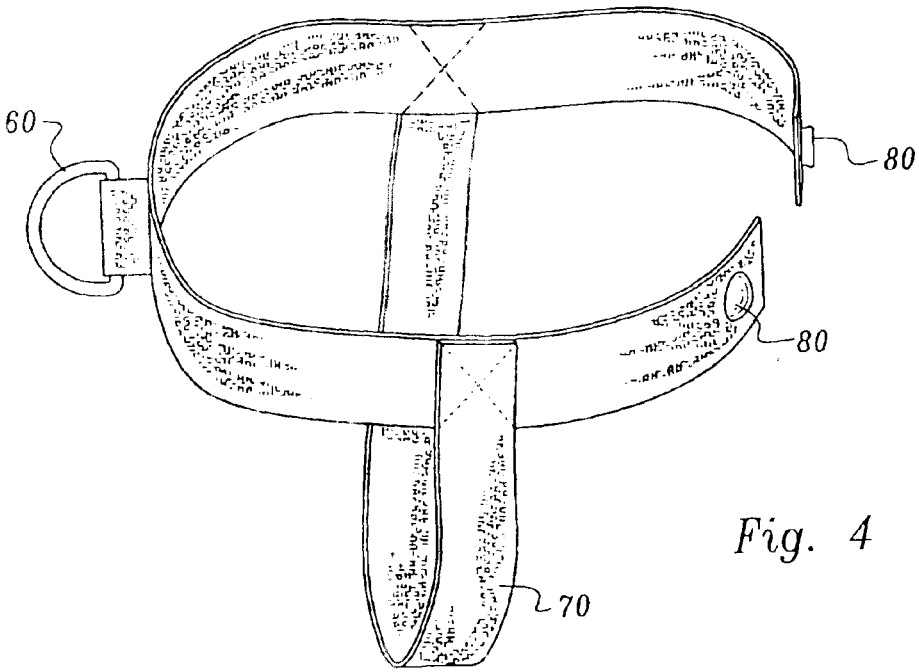
FIG. 4 is an isometric view of an embodiment of the foot strap of the present invention detailing the under-shoe portion 70 attachment to the ankle strap, the ankle strap which snaps 80 around the top of the athlete's ankle, and the ring 60 attached to the rear of the ankle strap.
Figure 5:
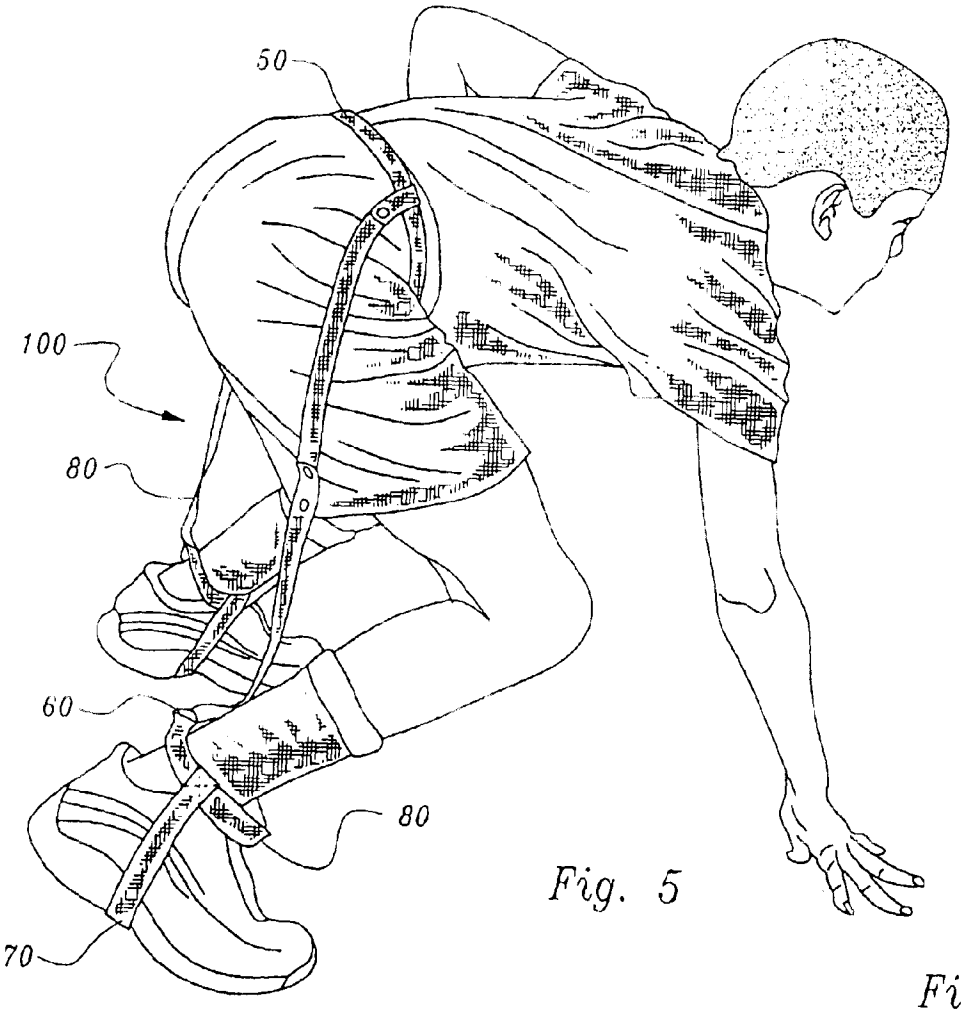
FIG. 5 shows the apparatus of an embodiment of the present invention with an athlete in the preferred posture position for a football offensive lineman.
Figure 7A:
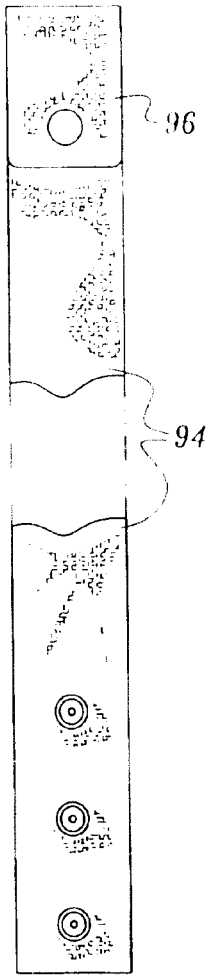
FIG. 7A is a front perspective view of an embodiment of the side strap top portion 94 of the present invention wherein the side strap snaps onto a side strap bottom portion.
Figure 7B:
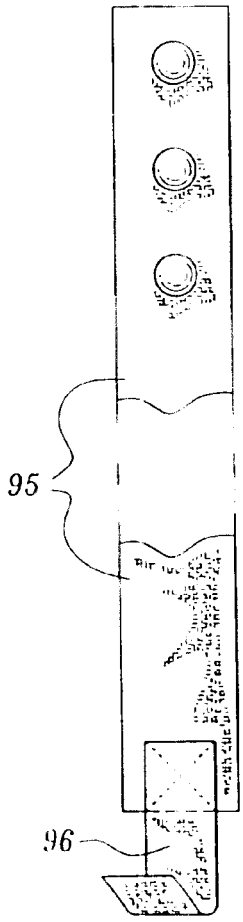
FIG. 7B is a front perspective view of an embodiment of the side strap bottom portion 95 of the present invention wherein the side strap snaps onto a side strap top portion.
Figure 7C:
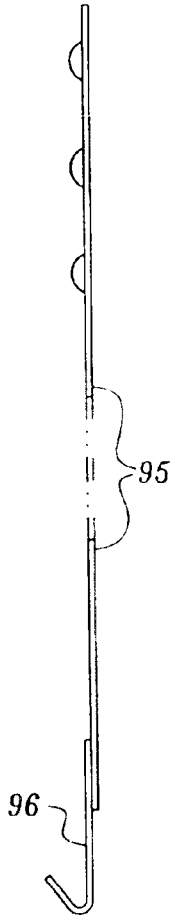
FIG. 7C is a side view perspective of the embodiment of the side strap of the present invention shown in FIG. 7B wherein the side strap snaps onto a side strap top portion.
Figure 7D:
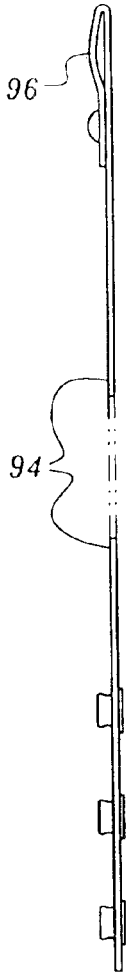
FIG. 7D is a side view perspective of the embodiment of the side strap of the present invention shown in FIG. 7A wherein the side strap snaps onto a side strap bottom portion.

With reference to FIGS. 1, 2 and 5, the apparatus 100 comprises a belt or strap or similar means 50 to adjustably fit and secure the apparatus around the waist of the uniformed athlete or further comprises means to attach to the belt of the athlete's uniform pants. As depicted in FIGS. 1 through 5, the apparatus further comprises straps or other means to adjustably fit and secure the apparatus around each foot of the athlete wearing the shoe or boot of the athlete's respective sport. FIGS. 3 and 4 show an embodiment of the means to adjustably fit and secure the apparatus around each foot of the athlete wearing the shoe or boot of the athlete's respective sport further comprises an adjustable ankle strap having a forward front side with snap attachment 80 and a rear back side. This embodiment of the foot strap element of the present invention, FIGS. 3 and 4, comprises a single strap 70 having two ends, wherein the first end is attached to the middle of the ankle strap at a point equidistant between the forward front side and back side on the portion of the ankle strap located on the outside of the ankle, wherein the strap forms a loop to be secured beneath the shoe bottom, and wherein the second end is adjustably attached to the middle of the ankle strap at a point equidistant between the forward front side and back side on the portion of the ankle strap located on the inside of the ankle securing the strap around the shoe bottom. The rear back side of the adjustable ankle strap has a metallic or high-impact grade plastic foot attachment ring 60 securely attached thereto. In this fashion, the foot attachment ring 60 extends behind the athlete's heel to allow attachment to the side strap bottom, as depicted in FIGS. 1 through 3, and 5. The material and sizing of the single strap 70, and its placement under the footwear of the athlete, allows for use of the present invention in sporting activities where the athlete's footwear further comprises cleats, such as football and the like, or is engaged in a binding or other securing mechanism, such as alpine skiing, without effecting operation of the cleats or binding or securing mechanism.

Figure 6B:
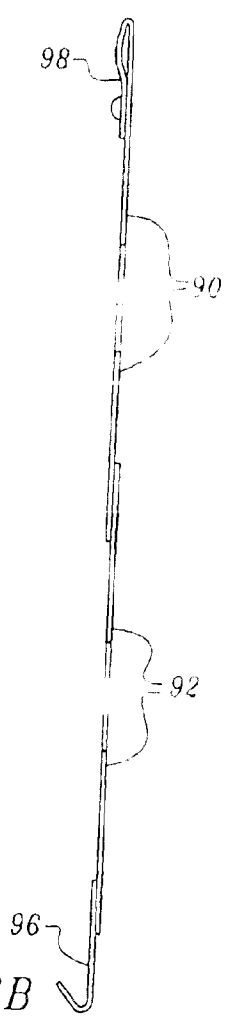
FIG. 6B is a side view perspective of the embodiment of the side strap of the present invention shown in FIG. 6A wherein an elasticized portion 92 is sewn into the strap.
Figure 6A:
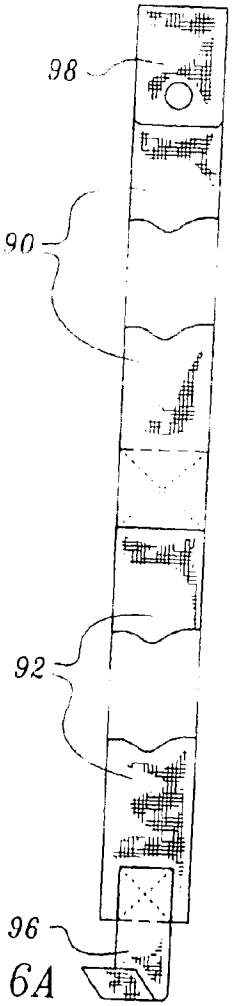
FIG. 6A is front view perspective of an embodiment of the side strap of the present invention wherein an elasticized portion 92 is sewn into the strap.

FIG. 1 depicts vertically oriented straps or similar means is 90 adjustably connected to the waist fitting means 50 and separately to each metallic or plastic foot attachment ring 60 and further comprises means to release the connection means from the foot fitting means when the athlete's leg extension exceeds a predetermined angle. Each strap 90 further comprises a top end 98, a bottom end 96, and lengthening adjustment means wherein the strap length can be sized to a predetermined dimension, wherein each top strap end 98 comprises means to attach to the waist fitting means, and wherein each bottom strap end 96 comprises means to attach to one of the foot fitting means. One embodiment of the straps 90 of the present invention shown in FIGS. 6A and 6B comprises an elasticized portion 92 which is attached to the bottom strap end 96 by cross-stitching and attached to the top strap end by snaps. Another embodiment of the straps 90 comprises a hook-less buckle adjustment to adjust the straps according to the heel to waist dimension when the athlete is in proper position [not shown]. Yet another adjustment means for the straps 90 are snaps is depicted in FIGS. 7A through 7D, wherein the strap 90 is divided at a near midpoint into a top portion 94 and a bottom portion 95 and whereby snaps allow the strap top portion 94 to be connectedly shortened or lengthened by adjustable connection to the strap bottom portion 95 as determined by the length of the waist-ankle distance once the athlete has assumed the proper posture for the position to be practiced. The size of snaps providing sufficient resistance required to hold the straps throughout the training method using the present invention without releasing are ⅝".

The means to attach the top strap end 98 to the waist fitting means 50 further comprises a metallic snap attachment, or the like, whereby the top strap end 98 is looped over the waist fitting means 50 and secured thereto by closing the snap, and whereby the top strap end 98 can travel along the waist fitting means. Again, the size snap required to secure the top strap end 98 to the waist fitting means 50 throughout the training method using the present invention without releasing are ⅝".

The means to attach the bottom strap end 96 to the ring 60 of foot fitting means further comprises at least one end having hook and loop self-gripping fastening devices known in the art as VELCRO®. The VELCRO® end closes around the ring 60 in a self-attaching loop, and which releases upon the force applied when the athlete's leg extension exceeds a predetermined angle, as depicted in FIG. 2. It is critical that the releasing bottom strap end 96 be at the bottom of the strap 90 as opposed to the top 98 to avoid loose strap ends being on the sport playing surface and/or under the athlete's feet, either of which condition would present the likelihood for injury.

The apparatus of the present invention thus provides a useful and novel method of training an athlete to maintain a low center of gravity during a particular phase of competition wherein both of the athlete's feet begin beneath the athlete and the athlete's footwear is in contact with a playing surface, sporting implement such as a ski, or the ground. The method of the present invention begins with selecting the phase of competition for the desired training. For instance, the apparatus of the present invention can be used to train football offensive linemen as depicted in FIG. 5 to keep a pre-snap, three or four point stance wherein the lineman's head is kept up, the hips are kept low, and the legs are bent at an angle adequate to maintain this low center of gravity. As long as the athlete maintains proper position with the hips low, knees bent, and each foot aligned under the corresponding hip/shoulder, the straps 90 become taut but do not break loose from the foot attachment ring 60, as shown in FIG. 1. Similar low center of gravity body positioning is essential in numerous other sporting activities such as downhill slalom skiing, certain tennis ground strokes from the baseline, certain low ground ball fielding postures in baseball, initial sprinting positions in track, and standing start positions in wrestling, and the like. The apparatus and method of the present invention can be used in these and any other sports which require the athlete to stay low relative to the action of the particular sport for proper posture and balance considerations.

With the exception of the hook and loop self-gripping fastening devices known in the art as VELCRO®, snaps, and elasticized elements, the strap elements of the present invention can be constructed of high strength nylon belting materials, and the like. The snaps are either plastic or metal, and the like, with the preferred embodiment using brass snaps.

Once the desired position is understood and conveyed to the athlete, the athlete is placed in the position according to the desired phase of the competition or sport. Once positioned, the vertical distance between the athlete's heels and waist while positioned in the desired phase are measured. The length of each of two straps 90, FIG. 1, is adjusted consistent with the vertical distance measurement of the preceding step. The athlete is suited up or otherwise dressed in the uniform or clothing to be worn in the competition, including footwear appropriated thereto. A strap 50, FIG. 1, is adjustably and securely fitted around the waist of the athlete's uniform or clothing, with an embodiment of the strap 50 comprising means to attach to the belt of the athlete's uniform or clothing. Each of the athlete's feet within the footwear appropriate to the sport are secured with an attachment means on the outside of the footwear worn by the athlete, FIGS. 1, 3 and 5. As depicted in FIGS. 1, 2 and 5, each adjusted strap length top end 98 is secured to the waist strap 50 so that each adjusted strap length hangs down the outside of one of the athlete's thighs. The athlete is repositioned in the position from which the measurements of the preceding steps were taken, FIG. 5, and each adjusted strap length bottom end 96 is attached to the corresponding foot attachment ring 60, FIGS. 1, 3, and 5. The desired phase of the sporting activity is practiced with the athlete positioned by the apparatus through the movements. Each time a strap length bottom end 96 releases from a foot attachment ring 60, as shown in FIG. 2, play is stopped allowing the coach or instructor to evaluate the reasons for the athlete's failure to maintain the desired position or low center of gravity. Corrective action can be taken, or the strap length can be adjusted as necessary. These practice steps are repeated, as appropriate to each athlete's ability, until the desired level of training has been achieved.

I claim:

1. An apparatus for training athletes to maintain a low center of gravity, comprising:

means to adjustably fit and secure the apparatus around the waist of the uniformed athlete;

means to adjustably fit and secure the apparatus around each foot of the athlete wearing the shoe or boot of the athlete's respective sport; and means to adjustably connect the waist fitting means separately to each foot fitting means comprising means to release the connection means from the foot fitting means when the athlete's leg extension exceeds a predetermined angle.

2. The apparatus of claim 1, wherein means to adjustably fit and secure the apparatus around the waist of the uniformed athlete further comprises a strap comprising means to attach to the belt of the athlete's uniform pants.

3. The apparatus of claim 2, wherein the strap further comprises nylon.

4. The apparatus of claim 1, wherein means to adjustably fit and secure the apparatus around each foot of the athlete wearing the shoe or boot of the athlete's respective sport further comprises an ankle strap having an adjustable forward front side and a rear back side, a second scrap having two ends, wherein the second strap first end is attached to the middle of the ankle strap at a point equidistant between the forward front side and back side on the outer portion of the ankle strap, wherein the strap forms a loop to be secured beneath the shoe bottom, wherein the second strap second end is adjustably attached to the middle of the ankle strap at a point equidistant between the forward front side and back side on the inner ankle portion of the ankle strap securing the strap around the shoe bottom, and wherein the back side ankle strap further comprises a metallic ring securely attached thereto at a position behind the athlete's heel.

5. The apparatus of claim 4, wherein the ankle strap and the second strap further comprise nylon.

6. The apparatus of claim 1, wherein means to adjustably connect the waist fitting means separately to each foot fitting means further comprises two straps, each strap comprising a top end, a bottom end, and lengthening adjustment means wherein the strap length can be sized to a predetermined dimension, wherein each top strap end comprises means to attach to the waist fitting means, and wherein each bottom strap end comprises means to attach to one of the foot fitting means.

7. The apparatus of claim 6, wherein means to attach the top strap end to the waist fitting means further comprises a metallic snap attachment whereby the top strap end is looped over the waist fitting means and secured thereto by closing the snap, and whereby the top strap end can travel along waist fitting means.

8. The apparatus of claim 6, wherein means to attach the bottom strap end to the foot fitting means further comprises at least one end having hook and loop self-gripping fastening devices which closes around attachment means on the foot fitting means, and which releases therefrom upon the force applied when the athlete's leg extension exceeds a predetermined angle.

9. The apparatus of claim 6, wherein the straps further comprise an elasticized portion.

10. The apparatus of claim 6, wherein strap lengthening adjustment means further comprises a hook-less buckle adjustment.

11. The apparatus of claim 6, wherein strap lengthening adjustment means further comprises an adjustable snap assembly.

12. A method of training an athlete to maintain a low center of gravity during a particular phase of competition wherein both of the athletes feet begin beneath the athlete and in contact with a playing surface or the ground, the method comprising the steps of:

selecting the phase of competition for the desired training;

positioning the athlete according to the desired phase;

measuring the vertical distance between the athlete's heels and waist while positioned in the desired phase;

adjusting the length of each of two straps, each strap comprising an attachable top end, a releaseable bottom end, and lengthening adjustment means to the vertical distance measurements of the preceding step predetermined dimension;

dressing the athlete in the uniform or clothing to be worn in the competition;

adjustably and securely fitting the athlete with a strap around the waist of the uniform or clothing, the strap comprising means to attach to the belt of the athlete's uniform or clothing;

fitting each foot of the athlete with the footwear of the particular sport;

fitting each foot with a foot attachment secured on the outside of the footwear worn by the athlete;

attaching each adjusted strap length top end to the waist strap so that each adjusted strap length hangs down the outside of one of the athlete's thighs;

repositioning the athlete in the position from which the measurements of the preceding steps were taken;

attaching each adjusted strap length bottom end to the corresponding foot attachment;

proceeding with the desired phase of the sporting activity;

stopping the activity each time a strap length bottom end releases from a foot attachment;

evaluating the reasons for the athlete's failure to maintain the desired low center of gravity;

taking corrective action;

adjusting the strap length as necessary; and repeating the steps until the desired level of training has been achieved.

13. A kit for training athletes to maintain a low center of gravity, comprising, in combination:

a waist strap comprising means to attach to the belt of the athlete's uniform pants;

an ankle strap having an adjustable forward front side and a rear back side, a second strap having two ends, wherein the second strap first end is attached to the middle of the ankle strap at a point equidistant between the forward front side and back side on the outer portion of the ankle strap, wherein the strap forms a loop to be secured beneath the shoe bottom, wherein the second strap second end is adjustably attached to the middle of the ankle strap at a point equidistant between the forward front side and back side on the inner ankle portion of the ankle strap securing the strap around the shoe bottom, and wherein the back side ankle strap further comprises a metallic ring securely attached thereto at a position behind the athlete's heel; and two side straps, each side strap comprising a top end, a bottom end, and lengthening adjustment means wherein the strap length can be sized to a predetermined dimension, wherein each top strap end comprises means to attach to the waist strap, and wherein each bottom strap end comprises means to attach to the metallic ring on one of the ankle straps.

14. The kit of claim 13 wherein the straps further comprise nylon.

15. The kit of claim 14 including an elasticized portion on each of the side straps.

16. The kit of claim 15 wherein means to attach to the metallic ring on the ankle strap further comprises a strip having hook and loop self-gripping fastening means which attaches to the ring by forming a self-attaching loop.

17. The kit of claim 15 including a metallic snap attachment whereby each side strap top end is looped over the waist strap and secured thereto by closing the snap, and whereby each side strap top end can travel along the waist strap.

18. The kit of claim 17 including a hook-less buckle adjustment on each of the side straps wherein the side strap length can be adjusted.

19. The kit of claim 17 including an adjustable snap assembly on each of the side straps wherein the side strap length can be adjusted.

* * * * *